United States Patent [19]

Polan

[11] Patent Number: 4,529,486

[45] Date of Patent: Jul. 16, 1985

[54] ANODE FOR CONTINUOUS ELECTROFORMING OF METAL FOIL

[75] Inventor: Ned W. Polan, Madison, Conn.

[73] Assignee: Olin Corporation, New Haven, Conn.

[21] Appl. No.: 568,676

[22] Filed: Jan. 6, 1984

[51] Int. Cl.[3] ..... C25D 1/04; C25D 17/00

[52] U.S. Cl. ..... 204/13; 204/213; 204/215; 204/216

[58] Field of Search ..... 204/13, 212, 213, 215, 204/216

[56] References Cited

U.S. PATENT DOCUMENTS

| | | | |
|---|---|---|---|
| 1,417,464 | 5/1922 | Edison | 204/13 |
| 1,543,861 | 6/1925 | McCord | 204/13 |
| 1,952,762 | 3/1934 | Levy et al. | 204/213 |
| 1,969,054 | 8/1937 | Wilkins | 204/13 |
| 2,044,415 | 6/1936 | Yates | 204/213 |
| 2,865,830 | 12/1958 | Zoldas | 204/13 |
| 3,461,046 | 8/1969 | Clancy | 204/13 |
| 4,318,794 | 3/1982 | Adler | 204/212 |
| 4,431,500 | 2/1984 | Messing | 204/13 |

FOREIGN PATENT DOCUMENTS

| | | |
|---|---|---|
| 1543301 | 4/1979 | United Kingdom . |
| 1548550 | 7/1979 | United Kingdom . |

*Primary Examiner*—John F. Niebling

*Attorney, Agent, or Firm*—Barry L. Kelmachter; Howard M. Cohn; Paul Weinstein

[57] ABSTRACT

An electroforming apparatus for producing metal foil having a rotating drum cathode and an improved anode construction and a process for using the apparatus are described. The improved anode construction comprises an arcuate anode having a perforated zone. The perforated zone is placed over a manifold for distributing electrolyte into a gap between the cathode and anode for providing a more uniform current distribution and a more uniform foil deposition in the plating region over the manifold as well as other advantages.

16 Claims, 3 Drawing Figures

ANODE FOR CONTINUOUS ELECTROFORMING OF METAL FOIL

The present invention relates to an electroforming apparatus and process and more particularly to an improved anode for use therein.

The production of electroformed or electrodeposited metal foil, especially copper foil, is of considerable importance because of its use in the production of printed circuits for electronic and electrical equipment. As demonstrated by U.S. Pat. Nos. 1,417,464 to Edison and 1,543,861 to McCord, the basic electroforming technology is old and well-known in the art. Generally, the metal foil is formed by partially immersing and rotating a cylindrical cathode in an appropriate electrolyte and applying an electrical current between the cathode and an anode which is also at least partially immersed in the electrolyte. When the plated surface of the cylindrical cathode emerges from the electrolyte, the metal foil formed thereon is stripped from the surface and coiled on a roll.

To promote the formation of metal foil having a uniform thickness, at least one stationary anode is mounted in the electrolytic cell concentric with the rotating drum cathode. By doing this, a uniform spacing between the drum cathode and the stationary anode or anodes can be maintained. For convenience, two anodes, each somewhat less in length than one-quarter of the circumference of the drum cathode, are usually used. Depending upon the length of the anodes, the type of system used, and the type of deposit to be formed on the rotating cathode, more than two anodes may be used. For example, in U.S. Pat. No. 1,952,762 to Levy et al., the deposition anode in one embodiment comprises a pair of anodes and a pair of spaced apart additional anode plates. The additional anode plates are employed because the anodes themselves are not of sufficient size to extend around the entire submerged portion of the rotating drum. In U.K. Pat. Nos. 1,543,301 and 1,548,550, the deposition anode is divided into a plurality of sections so that it is possible to apply different voltages to different sections. By applying different voltages to different sections, it is possible to form the metal foil in one zone and apply a nodular or dendritic layer to the metal foil in a second zone while the metal foil is still on the rotating drum cathode.

In most electroforming systems used today, a split anode having a central passageway or manifold between the anode sections is employed. The passageway or manifold feeds electrolyte across the bottom of the rotating drum cathode and into the gap between the cathode and the anode sections. This arrangement is intended to provide fresh electrolyte along the plating surface of the cathode. U.S. Pat. Nos. 2,044,415 to Yates, 2,865,830 to Zoldas and 3,461,046 to Clancy exemplify such systems.

It has been discovered that these systems often fail to produce metal foil having a uniform thickness. To produce a uniform metal deposit on a rotating drum cathode, each element of area along any line on the plating surface parallel to the drum axis must in a revolution of the drum receive the same number of coulombs of electricity at the same average current efficiency. In systems having a split anode, a non-uniform current distribution often occurs as the rotating drum cathode and the metal deposited thereon pass over the separation between the anode sections. This non-uniform current distribution leads to non-uniform plating in this region. In addition, the electrolyte impinging on the plating surface and the metal deposit as they pass over the manifold and the separation may adversely affect the production of uniform metal deposits. This can be particularly troublsome when the electrolyte is rapidly pumped through the manifold.

It has been suggested in the prior art that these problems may be overcome by using a specially designed anode and a particular type of manifold arrangement. The specially designed anode comprises a pair of spaced apart strips of dimensionally stable anode material having a plurality of holes therein. The holes permit substantially free electrolyte flow through the strips from one side to the other side thereof. The manifold or electrolyte supply conduit provides a flow of electrolyte into the space between the anode and the cylindrical cathode. U.S. Pat. Nos. 4,318,794 to Adler illustrates this type of system. The main deficiency of this system appears to be its use of spaced apart anode strips as a non-continuous anode.

In accordance with the present invention, the shortcomings of the prior art systems are overcome by providing an apparatus for continuously electroforming metal foil that utilizes an improved anode construction. The improved anode configuration of the present invention provides a more uniform current distribution and foil deposition throughout the plating zone of the electroforming apparatus. As a result of this, overall foil quality is significantly improved.

The apparatus of the present invention includes a cylindrical cathode which is rotated about a desired axis and is partly submerged in an electrolyte. Spaced from the cathode is the anode of the present invention which comprises a single substantially continuous anode having a perforated zone. In a preferred manner of using the anode of the present invention, the perforated zone is positioned over an inlet manifold for providing electrolyte to the gap between the anode and the cathode. The anode configuration of the present invention particularly provides a more uniform current distribution and more uniform foil deposition in the plating region over the manifold. By replacing the wide discontinuous anode gap associated with prior art systems with a plurality of relatively small perforations, the aforementioned benefits can be achieved.

The anode of the present invention also acts as an obstacle to the electrolyte flow from the manifold. The perforations in the anode tend to break up the electrolyte flow and create more turbulence therein. Turbulence in the electrolyte flow is desirable because it assists in providing fresh metal species to the plating surface on the rotating drum cathode.

It is an object of the present invention to provide an improved anode for use in an apparatus for continuously electroforming metal foil.

It is a further object of the present invention to provide an anode as above which provides a more uniform current distribution and foil deposition throughout the plating region.

It is a further object of the present invention to provide an anode as above having longer life and requiring less maintenance.

It is a further object of the present invention to provide a process for using the above electroforming apparatus and anode.

These and other objects, features and advantages will become apparent from the following description and drawings in which like reference numerals designate like elements.

Figure 1:
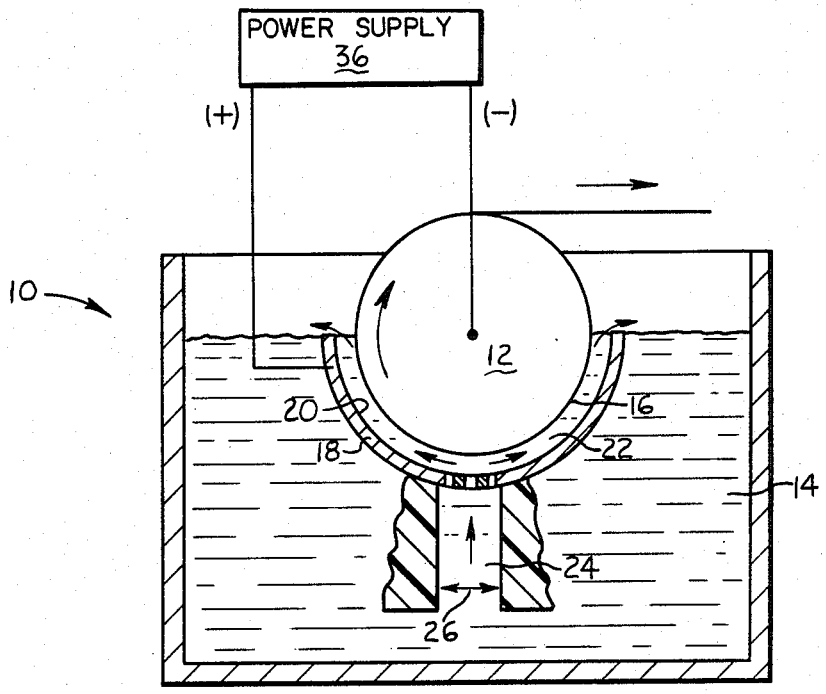
FIG. 1 is a schematic illustration in partial cross section of the electroforming apparatus of the present invention.

In accordance with the present invention, an improved anode construction for use in an electroforming apparatus for continuously producing metal foil is provided. While the following description describes the invention in the context of forming copper foil, the process and apparatus of the present invention have utility in forming other metal and metal alloy materials.

Referring now to the figures, the apparatus comprises an electrolytic cell having a tank 10 formed from a suitable inert material such as lead or stainless steel. If desired, the tank 10 may be formed from any appropriate structural material such as concrete. Inner linings not shown of corrosion resistant materials such as polyvinyl chloride or rubber may be used with structural materials like concrete.

In the tank 10, a drum cathode 12 is mounted for rotation about a substantially horizontal axis. Any suitable conventional mounting means (not shown) known in the art may be used to mount the drum cathode 12 in the tank 10. The rotating drum cathode 12 may be formed from any suitable electrically conductive metal or metal alloy including lead, stainless steel, columbium, tantalum, titanium, chromium and alloys thereof. In a preferred construction, the drum cathode comprises a stainless steel drum having a polished plating surface formed from titanium, columbium, tantalum or an alloy thereof. The drum cathode 12 may be rotated by any suitable motor drive arrangement (not shown) known in the art. The cathode 12 is mounted in the tank 10 so that it is at least partially immersed in an electrolyte solution 14. In a preferred arrangement, about half of the drum cathode extends beneath the surface of the electrolyte 14.

The electrolyte 14 generally comprises an acidic solution containing a concentration of ions of a metal or metals to be electrodeposited onto the plating surface 16 of the rotating drum cathode. For example, if copper is to be electrodeposited, the electrolyte 14 contains a concentration of copper ions. In a preferred embodiment for electroforming copper foil using the apparatus of the present invention, the electrolyte 14 comprises a copper sulfate-sulfuric acid solution. During operation, the solution is preferably maintained at a temperature in the range from about room temperature to about 100° C. It has been found to be quite advantageous to maintain the solution at a temperature of about 60° C. When maintained at about 60° C., the solution may have a concentration of copper, preferably in the form of copper sulfate, of about 10 grams/liter, hereinafter g/l, to about 320 g/l, preferably from about 200 g/l to about 300 g/l. The sulfuric acid can be present in the electrolyte 14 in a concentration up to that which causes the copper to precipitate out as copper sulfate. The concentration of sulfuric acid for an electrolyte substantially at 60° C. should be in the range of about 10 g/l to about 100 g/l.

It should be recognized that the aforementioned copper sulfate and sulfuric acid concentrations are dependent upon the electrolyte temperature. If desired, the tank 10 may be provided with means, not shown, for maintaining the electrolyte temperature at the desired temperature. The temperature maintaining means may comprise any suitable means known in the art such as a heating and/or cooling loop. The copper sulfate and sulfuric acid concentrations may be adjusted if the electrolyte temperature is other than that described above. At elevated temperatures, the copper sulfate concentration range may be increased beyond the aforementioned concentration range because its solubility limit increases with temperature. If desired, a proteinaceous material such as gelatin or animal hide glue may be added as is known in the art to the copper sulfate-sulfuric acid electrolyte to further facilitate the electroforming process.

Mounted in close proximity to the rotating drum cathode 12 is the anode 18 of the present invention. The anode 18 is preferably insoluble and, as can be seen from FIGS. 1 and 2, has an arcuate configuration. It may be mounted in the tank 10 by any suitable mounting means (not shown) known in the art. It is desirable to mount the anode 18 in the tank 10 so that it is substantially concentric with the rotating drum 12. By doing this, the interelectrode gap 22 between the plating surface 16 and the anode surface 20 is substantially constant throughout the plating zone.

The gap 22 between the plating and anode surfaces 16 and 20, respectively, may have any size. However, there is the limitation that if it is too wide, there will be a significant IR loss across the gap. Practically, this means that the gap should be less than about 50 millimeters. Preferably, the gap 22 is in the range of about 5 millimeters to about 15 millimeters, most preferably from about 7 millimeters to about 11 millimeters.

To provide fresh electrolyte in a substantially continuous fashion to the gap 22, a manifold 24 is mounted in the tank 10. The manifold extends in a direction parallel to the rotation axis of the drum cathode 12 and has a length substantially equal to the length of the drum cathode. The manifold 24 preferably has a width 26 sufficient to permit adequate electrolyte flow into the gap 22. Generally, the manifold width 26 is about twice as large as the interelectrode gap 22. If desired, the manifold 24 may be connected to a pump not shown so that a desired electrolyte flow pattern may be created throughout the cell. If a pump is utilized, any suitable pump known in the art may be used. The manifold 24 may be mounted in the tank 10 in any suitable fashion using any suitable mounting means (not shown) known in the art and may be formed from any suitable material such as a plastic material.

As previously discussed, the region over the manifold is left open in most electroforming apparatuses. As a result, the electrolyte flowing through the manifold directly impinges on the plating surface of the rotating drum. This in part causes a non-uniform metal deposit on the cathode plating surface. In addition, the current distribution in the plating region over the manifold generally is non-uniform. This compounds the problem of non-uniform plating in this region of the plating zone. The anode 18 of the present invention overcomes these shortcomings by having a perforated zone 28 positioned over the outlet of the manifold 24. The perforated zone 28 comprises a plurality of perforations 30 in an otherwise continuous anode construction. It has been discovered that this perforated zone provides a more uniform current distribution and foil deposition in the region over the manifold. This is primarily due to the fact that the electropotential difference between the two substantially solid anode sections 32 and 34 is reduced to the IR drop of the connecting perforated zone 28. In addition, the perforated zone 28 acts as an obstacle to the flow of electrolyte and substantially prevents a stream of electrolyte from impinging onto the plating surface. As well as breaking up the electrolyte flow, the perforated zone creates turbulence in the electrolyte flow. This turbulence is desirable since it assists in providing fresh metal species to the plating surface 16 throughout the plating zone.

It has been found to be desirable to provide each perforation with at least one dimension, e.g. the diameter for a circular perforation, that is no more than about twice the size of the gap or the interelectrode spacing. Preferably, each perforation has one dimension that is substantially equal to or less than the size of the gap. While a circular shape is preferred, the perforations may have any desired shape. For example, each perforation could be an elongated slot. Alternatively, the perforations 30 in the zone 28 may have a combination of shapes, e.g. both circular and elongated slots.

The overall area of the perforated zone 28 is preferably about equal to or greater than about twice the cross-sectional area of the gap between the cathode and the anode, e.g. the interelectrode spacing multiplied by the length of the drum cathode 12 for the system illustrated in FIG. 1.

The anode 18 may be formed from any suitable electrically conductive material known in the art. For example, it can be formed from lead, antimony, platinum or alloys thereof. In a preferred arrangement, the anode is formed from a lead-antimony alloy. If desired, the perforated zone 28 of the anode may be formed from a different material than the substantially solid anode sections 32 and 34. This would be desirable where anode erosion in the region over the manifold is of particular concern. In those situations, the perforated zone 28 could be made from an electrically conductive material that is more resistant to erosion than the material forming the other anode sections. The anode 18 may have any desired length, although generally its length is substantially the same as the cathode length.

The anode 18 and the cathode 12 may be connected through any suitable means known in the art to a power supply 36. The power supply 36 may comprise any suitable conventional power supply known in the art. For example, power supply 36 may comprise a means for applying either an AC or DC current between the anode and cathode.

In operation, the cathode 12 is rotated at a desired speed and a current having a suitable current density is applied between the cathode 12 and the anode 18. The electrolyte 14 is preferably circulated so that it flows upwardly through the manifold 24, through the perforated zone 28, into the gap 22 between the anode and the cathode, and back into the tank 10 by spilling over the edges of the anode sections 32 and 34. As previously mentioned, if needed, a pump may be utilized to create the electrolyte flow. The rate of flow of electrolyte through the manifold 24 should be sufficient to provide fresh electrolyte to the gap 22 throughout the entire plating zone. Preferably, there are no interruptions in electrolyte being presented to the plating surface throughout the plating zone. Any suitable electrolyte flow rate may be utilized.

While the plating surface 16 is immersed in the electrolyte and current is being applied, metal will be deposited thereon. The metal deposit will take the form of a substantially continuous strip. After the plating surface 16 emerges from the electrolyte, the metal strip may be removed or peeled from the surface. Any suitable means (not shown) known in the art may be used to remove the metal strip. For example, the metal strip removing means shown in U.S. Pat. No. 2,865,830 to Zoldas or U.S. Pat. No. 3,461,046 to Clancy may be used. After the foil is removed from the surface of the cathode 12, it may be wound upon a suitable takeup reel (not shown).

In order to illustrate the present invention, the following example was performed.

EXAMPLE

Figure 2:
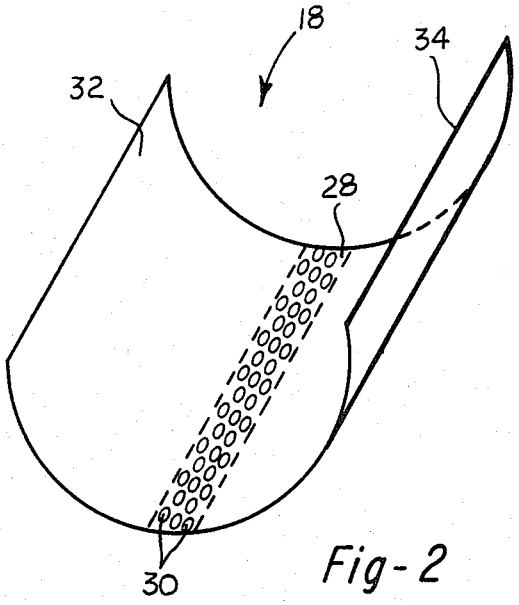
FIG. 2 is a schematic illustration of the improved anode construction of the present invention.
Figure 3:
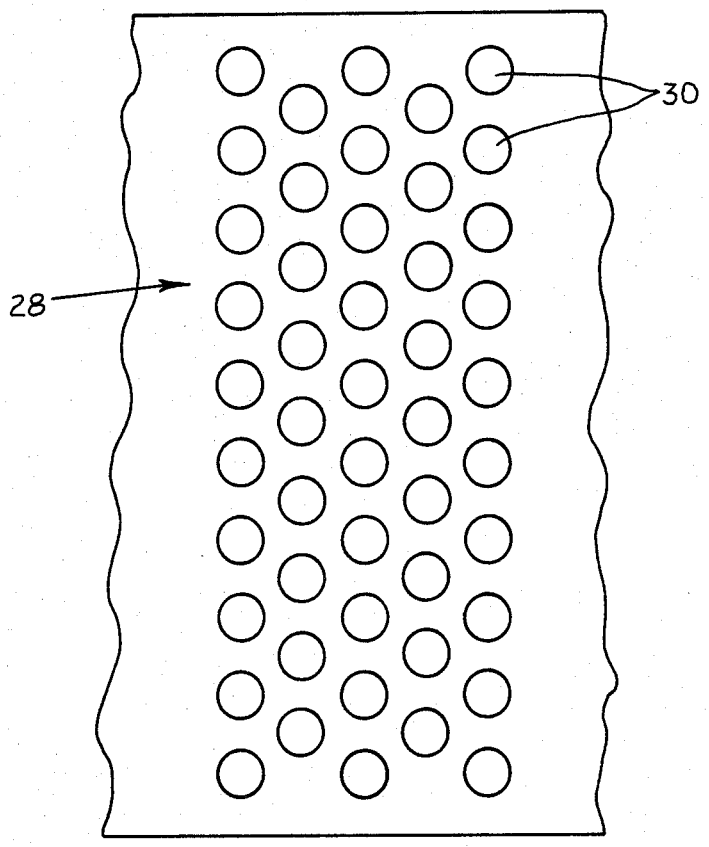
FIG. 3 is an exploded view of the perforated zone of the anode of FIG. 2.

An electroforming apparatus containing a rotating drum cathode and an anode similar to that shown in FIGS. 1–3 was constructed. The rotating drum cathode was about 30.5 cm. long and about 30.5 cm. in diameter. It had a highly polished titanium plating surface. The anode was mounted into the tank so that there was an interelectrode gap of about 6 mm. The anode had a length substantially equal to the length of the drum and had a perforated zone that was about 5 cm. wide. The perforated zone was placed over an inlet manifold having a 5 cm. wide gap. The perforated zone had a plurality of circular perforations in a staggered hexagonal array. The circular perforations each had a diameter of about 0.95 cm. and were spaced apart in a longitudinal direction by about 1.27 cm. center-to-center.

A copper sulfate-sulfuric acid solution containing a concentration of about 270 g/l copper sulfate and about 40 g/l sulfuric acid was placed in the tank. The solution was maintained at a temperature of about 60° C. This electrolyte solution was circulated through the tank using a pump that created an electrolyte flow rate in the interelectrode gap between about 1 to about 1.35 m/sec. A current density in the range of about 0.5 $A/cm^2$ to about 0.6 $A/cm^2$ was applied between the anode and the cathode.

For comparison purposes, an electroforming apparatus similar to that shown in FIGS. 1–3 with the exception that the anode comprised a split anode having two portions separated by an approximately 5 cm. gap which corresponded to the width dimension of the manifold was used. In this arrangement, there was no anode portion over the inlet manifold.

The foil produced by this latter apparatus had regions of discontinuity. In contrast, the foil produced in accordance with the present invention had substantially no discontinuities. It was also discovered that the mechanical properties of the foil were enhanced using the substantially continuous perforated anode of the present invention. For example, a standard tensile test for measuring ductility was conducted. The results are reported in Table I.

TABLE I

| TYPE OF ANODE | ELONGATION (% in 2") |
|---|---|
| Conventional | 2–7 |
| Perforated | 9–17 |

While any suitable electrolyte flow rate may be used in the present invention, it has been found to be desirable to use a flow rate in the range of about 1 meter/-second to about 4 meters/second, preferably from about 1 meter/second to about 2.5 meters/second.

A current at any suitable current density may be supplied to the cathode and the anode. It has been found to be desirable to use a current density in the range of about 0.4 $A/cm^2$ to about 2 $A/cm^2$, preferably from about 0.5 $A/cm^2$ to about 1.5 $A/cm^2$.

While the preferred embodiment of the invention has been described in connection with the production of copper foil, the apparatus and process of the present invention is equally applicable to the production of other metal and metal alloy foils including but not limited to lead, tin, zinc, iron, nickel, gold, silver and alloys thereof. Of course, the type of electrolyte, metal and acid concentrations in the electrolyte, the flow rate, and the current density used will have to be altered in accordance with the metal or metal alloy being plated.

While the cathode has been described as being a rotating drum cathode, it is also possible to use the anode of the present invention in an electroforming apparatus having an endless belt type cathode.

While the invention has been described as being part of a system for continuously producing metal foil, it may be also used as part of a system for producing metal foil in a non-continuous manner.

The patents and foreign patent publications set forth in the specification are intended to be incorporated by reference herein.

It is apparent that there has been provided in accordance with this invention an improved anode for continuous electroforming of metal foil which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for electroforming a continuous strip of metal foil, said apparatus comprising:

a cell having a tank containing an electrolyte;

a rotary drum cathode mounted in said tank, said cathode having a plating surface at least partially immersed in said electrolyte;

an anode having an arcuate configuration and being formed by a substantially continuous member having two arcuately shaped solid sections connected by a central perforated zone, said anode mounted in said tank substantially concentric with said cathode and defining a substantially constant interelectrode gap with cathode, said substantially constant interelectrode gap promoting formation of a metal foil having a substantially uniform thickness;

means for flowing said electrolyte into said interelectrode gap only through said central perforated zone so that said electrolyte flows initially into a central portion of said interelectrode gap, then between each of said solid sections and said plating surface and finally over the terminal portions of said solid sections back into said tank, said flowing means comprising a manifold for introducing said electrolyte into said central portion of said interelectrode gap; and said perforated zone providing a more uniform current distribution and foil deposition in the plating zone over said manifold.

2. The apparatus of claim 1 further comprising:

said manifold including a slot through which said electrolyte flows, said slot having a width; and said perforated zone having a width substantially equal to said slot width.

3. The apparatus of claim 2 further comprising:

said perforated zone including a plurality of perforations; and each said perforation having at least one dimension less than about twice said interlectrode gap.

4. The apparatus of claim 2 further comprising:

said gap having a cross-sectional area; and said perforated zone having an overall area at least equal to about twice the cross-sectional area of said interelectrode gap.

5. The apparatus of claim 2 wherein said anode further comprises:

each of said solid sections being formed from a first electrically conductive material; and said perforated zone being formed from a second electrically conductive material different from said first electrically conductive material.

6. The apparatus of claim 1 wherein:

said manifold comprises a slotted manifold through which said electrolyte flows into said interelectrode gap.

7. The apparatus of claim 6 further comprising:

said interelectrode gap being less than about 50 mm.

8. The apparatus of claim 7 further comprising:

said interelectrode gap being in the range of about 5 mm. to about 15 mm.

9. The apparatus of claim 3 further comprising:

each said perforation having at least one dimension less than about said interelectrode gap.

10. The apparatus of claim 4 further comprising:

said perforated zone area being greater than twice said cross-sectional area.

11. A process for electroforming a continuous strip of metal foil having a substantially uniform thickness, said process comprising:

providing a tank containing an electrolyte solution;

providing in said tank a drum cathode having a plating surface at least partially immersed in said electrolyte solution, said immersed plating surface defining the extent of a plating zone;

generating a substantially uniform current distribution throughout said plating zone for promoting formation of said substantially uniform thickness metal foil;

said generating step comprising providing a substantially continuous anode having an arcuate configuration and being formed by a substantially continuous member having two solid sections connected by a central perforated zone, said anode being mounted in said tank in substantially concentric relationship with said cathode so that said anode and said cathode define a substantially constant interelectrode gap;

flowing said electrolyte only through said central perforated zone of said anode so that said electrolyte flows initially into a central portion of said interelectrode gap, then between each of said solid sections and said plating surface and finally over the terminal portions of said solid sections back into said tank; and applying a current having a desired current density to said cathode and said substantially continuous anode for plating metal values from said electrolyte solution onto said plating surface, said arcuate configuration of said anode and said perforated zone promoting said substantially uniform current distribution throughout said plating zone.

12. The process of claim 11 further comprising:

said solution comprising a copper sulfate-sulfuric acid solution; and maintaining said solution at a temperature in the range from about room temperature to about 100° C., whereby said plated metal values comprise copper values.

13. The process of claim 12 further comprising:

flowing said electrolyte through said perforated zone at a flow rate in the range of about 1 m/sec. to about 4 m/sec.; and applying a current having a current density in the range of about 0.4 $A/cm^2$ to about 2 $A/cm^2$.

14. The process of claim 13 further comprising:

said flow rate being in the range of about 1 m/sec. to about 2.5 m/sec.; and said current density being in the range of about 0.5 $A/cm^2$ to about 1.5 $A/cm^2$.

15. The process of claim 14 further comprising: rotating said cathode at a desired speed.

16. The process of claim 15 wherein said flowing step further comprises:

flowing said electrolyte through a plurality of perforations in said central perforated zone for substantially preventing said electrolyte from directly impinging on said rotating cathode, for creating a more uniform current distribution in the region of said perforated zone, and for creating turbulence in said electrolyte flow, each said perforation having a dimension less than about twice said gap.

* * * * *